US006794808B2

(12) United States Patent
In et al.

(10) Patent No.: US 6,794,808 B2
(45) Date of Patent: Sep. 21, 2004

(54) FUNNEL FOR CATHODE RAY TUBE

(75) Inventors: Jun-Kyo In, Suwon (KR); Do-Nyun Kim, Suwon (KR); Jung-Mook Kim, Seoul (KR)

(73) Assignees: Samsung SDI Co., Ltd., Suwon-si (KR); Samsung Corning Co., Ltd., Suwon-si (KR)

( * ) Notice: Subject to any disclaimer, the term of this patent is extended or adjusted under 35 U.S.C. 154(b) by 78 days.

(21) Appl. No.: 10/101,875

(22) Filed: Mar. 21, 2002

(65) Prior Publication Data

US 2002/0190632 A1 Dec. 19, 2002

(30) Foreign Application Priority Data

Apr. 2, 2001 (KR) ..... 2001-17327

(51) Int. Cl.[7] ..... H01J 31/00
(52) U.S. Cl. ..... 313/477 R; 220/2.1 A
(58) Field of Search ..... 313/477 R, 478–482; 220/2.1 A, 2.3 A, 2.1 R

(56) References Cited

U.S. PATENT DOCUMENTS 3,969,647 A * 7/1976 Keen et al. ..... 313/477 HC
4,874,982 A * 10/1989 Overdijk et al. ..... 313/440
5,155,411 A * 10/1992 Swank et al. ..... 313/477 R
6,323,591 B1 * 11/2001 Oosterhout et al. ..... 313/477 R
6,534,908 B1 * 3/2003 Nose et al. ..... 313/477 R

FOREIGN PATENT DOCUMENTS

JP 2000-251766 9/2000

* cited by examiner

*Primary Examiner*—Nimeshkumar D. Patel
*Assistant Examiner*—German Colón
(74) *Attorney, Agent, or Firm*—Robert E. Bushnell, Esq.

(57) ABSTRACT

A funnel for a cathode ray tube includes a body portion having an opened end connected to a panel and an alignment mark formed on an outer surface of the body portion in the vicinity of the opened end, a neck portion for housing an electron gun, a yoke portion around which a deflection yoke is mounted, the yoke portion having a first end connected to the body portion at a top-of-round (TOR) and a second end connected to the neck portion. A convex portion having a thickness greater than 1 mm is provided on an outer portion of the body portion and/or yoke portion from the vicinity of the end of the alignment mark to the vicinity of the TOR in a direction of a tube axis.

20 Claims, 3 Drawing Sheets

FUNNEL FOR CATHODE RAY TUBE

CLAIM OF PRIORITY

This application makes reference to, incorporates the same herein, and claims all benefits accruing under 35 U.S.C. §119 from an application for *Funnel for Cathode Ray Tube and Cathode Ray Tube Having this Funnel* earlier filed in the Korean Industrial Property Office on Apr. 2, 2001 and there duly assigned Serial No. 2001-17327.

BACKGROUND OF THE INVENTION

1. Field of the Invention

The present invention relates to a cathode ray tube (CRT), and more particularly, to a funnel for a cathode ray tube, which is designed to reduce the occurrence of implosion and crack propagation.

2. Description of the Related Art

Generally, a CRT is designed to realize an image by emitting electron-beams from an electron gun and scanning a phosphor screen deposited with red (R), green (G), and blue (B) phosphors.

As the CRT takes up much space due to its full length in a direction of a tube axis when compared with flat display panels such as a plasma display, a field emission display, and a vacuum fluorescent display, a wide angle CRT having a deflection angle of electron beams of about 100° (degrees) has been developed.

To reduce the full length, the neck and yoke portion should be disposed close to an opened end of a funnel body portion.

However, according to a series of tests, it has been noted that a compressive stress of about 17 MPa (mega-Pascal) is applied in the vicinity of a top-of-round (TOR) defining a border between the body portion and the yoke portion when the funnel is designed having a similar thickness distribution to a conventional CRT. Such compressive stress of about 17 MPa causes the funnel to we be imploded in the safety standard test. In addition, it has been farther noted that the implosion occurrence of the CRT is above 90%, the scattering amount of fragments when the CRT is imploded is above 6 kg (kilograms), and the scattering distance is above 4 m (meters).

To solve the above problems, Japanese Laid-open Patent No. 2000-251766 for *Class Funnel Cathode Ray Tube, and Cathode Ray Tube Using it* by Murakami Toshihide discloses a CRT including a funnel designed having a similar thickness distribution to the conventional art, but having a thickness greater than that of the conventional art.

Describing in more detail with reference to FIG. 1, the CRT disclosed in the Japanese Laid-open Patent No. 2000-251766 includes a panel 110 and a funnel 112 connected to the panel 110. The funnel 112 includes a body portion 112*a* having an opened end fritted to the panel 110, a neck portion 112*c* in which an electron gun 114 is mounted and a yoke portion 112*b* is defined around a border between the body portion 112*a* and the neck portion 112*c*.

That is, the yoke portion 112*b* is designed having a predetermined curvature on the basis of a point located on an outer area of the funnel 112, and the body portion 112*a* is designed having a predetermined curvature on the basis of a point located on an inner area of the funnel 112. Namely, the border between the yoke portion 112*b* and the body portion 112*a* is defined on the TOR at which the curvatures of the yoke portion 112*b* and the body portion 112*a* become different.

The CRT further includes a frit portion 118 for attaching the panel 110 to the funnel 112, a phosphor layer 120 excited by electron beams, a shadow mask 122 for selecting the electron beams, an anode button 124, and a deflecting coil 116. The reference sign A indicates a tube axis connecting a center of the neck portion 112*c* to a center of the panel 110.

The thickness of the CRT is greater than the conventional CRT by 2 mm (millimeters).

However, as the thickness of the yoke portion is increased when compared with the conventional CRT, the deflection property of the deflection yoke is deteriorated, and the weight of the CRT is increased by up to 40%.

SUMMARY OF THE INVENTION

It is therefore an objective of the present invention to provide a funnel for a cathode ray tube that can prevent the deflection property of the deflection yoke from being deteriorated and that is can reduce the compressive stress in the vicinity of the TOR to reduce the occurrence of implosion as well as reduce the crack propagation speed and the scattering distance of the fragments when an implosion occurs.

It is another objective to not excessively increase the weighit of the funnel while decreasing the occurrence of implosion at the yoke and preventing the deterioration of the deflection property.

To achieve the above and other objectives, the present invention provides a funnel for a cathode ray tube, including a body portion having an opened end connected to a panel and an alignment mark formed on an outer surface of the body portion in the vicinity of the opened end; a neck portion for housing an electron gun; a yoke portion, around which a deflection yoke is mounted, the yoke portion having a first end connected to the body portion at a top-of-round (TOR) and a second end connected to the neck portion, where a convex portion having a predetermined thickness is provided on an outer portion of the body portion and/or yoke portion from a vicinity of the end of the alignment mark to a vicinity of the TOR in a direction of a tube axis.

Preferably, a distribution area of the convex portion is defined to satisfy the following condition:

$$Y((+))\{10\sim50\}(\text{mm})\leqq X\leqq \text{TOR}((+))10(\text{mm})$$

where X is the distribution area, Y is a location of the opened end, and the plus (((+))) indicates a direction from the opened end to the neck portion.

Another preferable distribution area X of the convex portion is defined by $Y((+))\{10\sim50\}(\text{mm})\leqq X\leqq \text{TOR}$.

Another preferable distribution area X of the convex portion is defined by $Y((+))10(\text{mm})\leqq X\leqq \text{TOR}$.

Further, preferably the predetermined thickness of the convex portion is greater than 1.0 mm (millimeters).

The convex portion is not provided on a portion of the body where an anode button is mounted since it is preferable that a portion of the funnel where the anode button is mounted has a depth of less than the depth of the anode button.

Preferably, the convex portion is formed in a symmetrical shape when viewed from the neck portion, and the yoke portion has a section having a circular-shape or a non-circular-shape.

According to another aspect, the present invention provides a cathode ray tube having a funnel as defined above.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
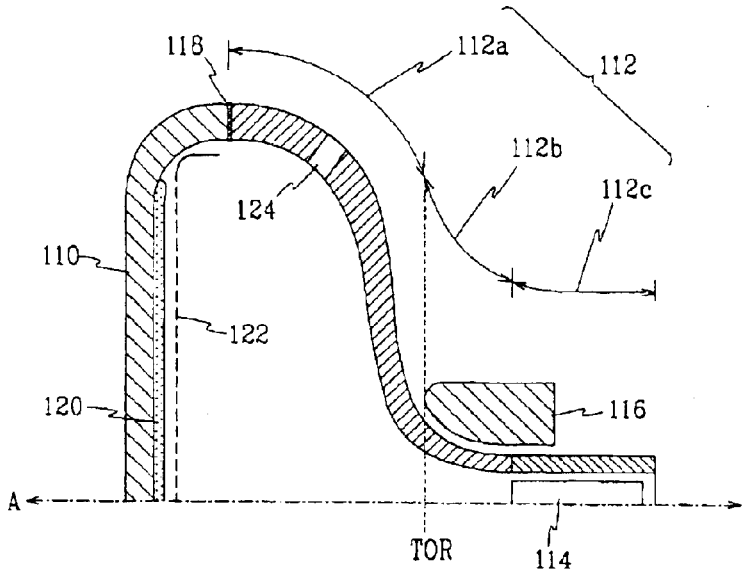
Fig. 1 (Prior art)
FIG. 1 is a partial sectional view of a prior art cathode ray tube.
Figure 2:
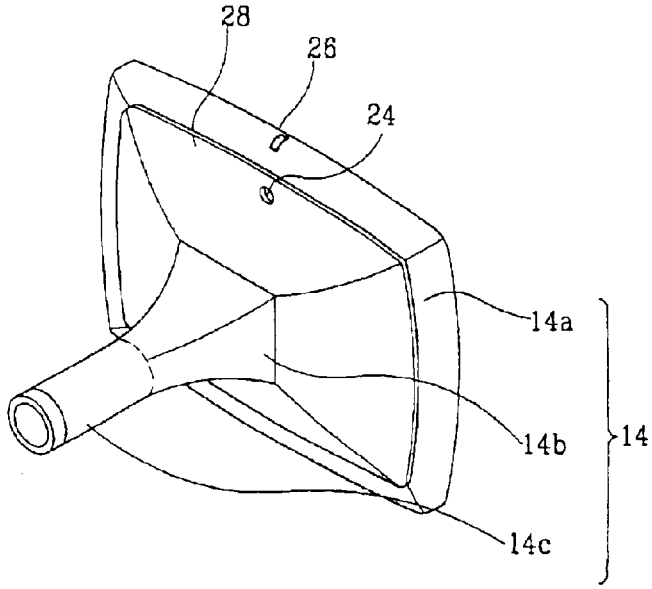
FIG. 2 is a front view viewed from a neck portion of a funnel according to a first preferred embodiment of the present invention.
Figure 3:
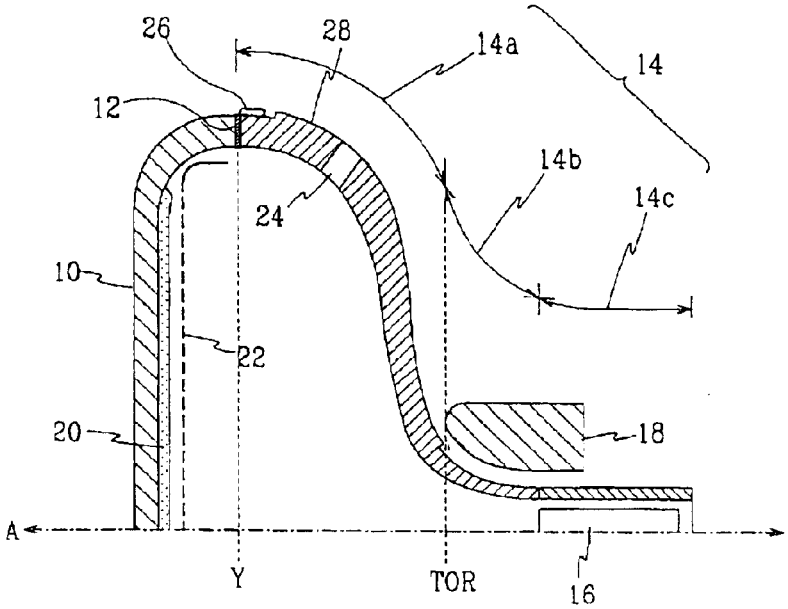
FIG. 3 is a sectional view of a cathode ray tube where a funnel according to a preferred age embodiment of the present invention is employed.

Turning now to the drawings, FIGS. 2 and 3 respectively show a funnel of the first embodiment of the present invention and a CRT where the inventive funnel is employed.

As shown in the drawings, the cathode ray tube includes a panel 10 for screening an image and a funnel 14 connected to the panel 10 by the frit portion 12.

The funnel 14 includes a body portion 14*a* having an opened end connected to the panel 10, a neck portion 14*c* for housing an electron gun 16, and a yoke portion 14*b* connecting the body portion 14*a* to the neck 14*c*. A deflection yoke 18 is mounted around the yoke portion 14*b*. A line of demarcation between the body portion 14*a* and the yoke portion 14*b* is set at the TOR on the basis of the location where the curvatures of the yoke portion 14*b* and the body portion 14*a* become different.

A phosphor screen 20 that is excited by electron beams emitted from the electron gun 16 is formed on an inner surface of the panel 10, and a shadow mask 22 for the color selection is mounted on the panel 10.

The cathode ray tube further includes an anode button 24, a tube axis A connecting the center of the panel 10 to the center of the neck portion 14*c*, and an alignment mark 26 used for ago aligning the panel 10 and the funnel 14 when they are connected through a fritting process.

Figure 5:
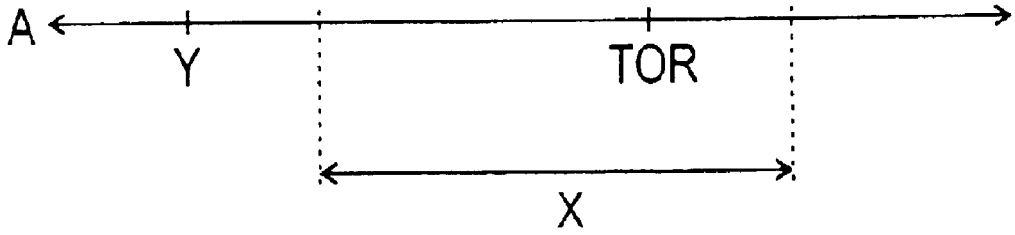
FIG. 5 is an example distribution area of the convex portion.

According to a feature of the present invention, a convex portion 28 having a predetermined thickness is provided on an outer portion of the body portion 14*a* and/or the yoke portion 14*b* from the vicinity of the end of the alignment mark 26 to the vicinity of the TOR in the direction of the tube axis A. Preferably, a distribution area X of the convex portion 28 is defined to satisfy the following condition:

$$Y((+))\{10\sim50\}(\text{mm})\leqq X\leqq \text{TOR}((+))10(\text{mm})$$

where X is the distribution area, Y is a location of the opened end, and the plus (((+))) indicates a direction from the opened end to the neck portion 14*c*. Stated another way, Y((+))z≦X≦TOR((+))10 millimeters where z is 10 millimeters≦z≦50 millimeters. An example distribution area X of the convex portion 28 is shown in FIG. 5. If the distribution area is below Y((+))10 mm, a forming character of a funnel is unsatisfactory. If the distribution area is above TOR((+))10 mm, a deflection property of the deflection yoke is decreased and a crack propagation speed is not reduced effectively so that the distance of fragment scattering is not reduced.

More preferably, the distribution area X of the convex portion 28 is defined to satisfy the following condition:

$$Y((+))\{10\sim50\}(\text{mm})\leqq X\leqq \text{TOR}$$

and more preferably the distribution area X of the convex portion 28 is defined to satisfy the following condition:

$$Y((+))10(\text{mm})\leqq X\leqq \text{TOR}.$$

The convex portion 28 is symmetrical when viewed from the neck portion 14*c*. It is thought that atmosphere pressure applied to the funnel is symmetrical. Therefore, it is better to form a symmetrical convex portion 28.

Figure 4:
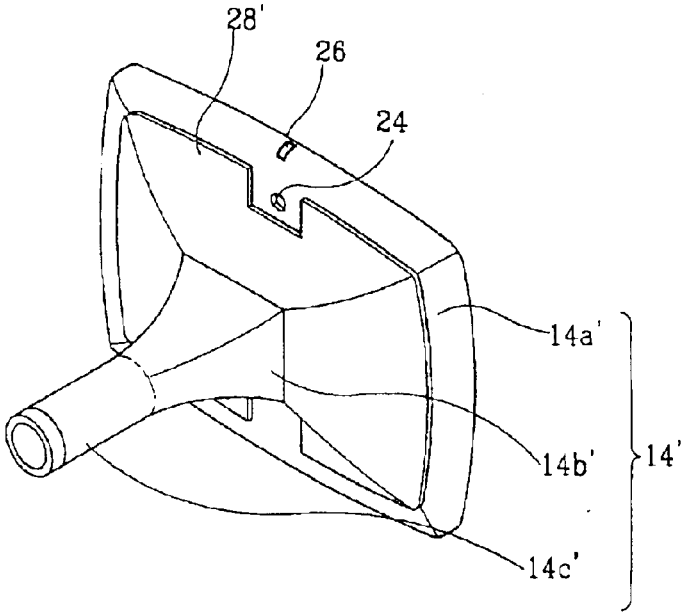
FIG. 4 is a front view from a neck portion of a funnel according to a second preferred embodiment of the present invention.

However, since it is preferable that a portion of the funnel 14 where the anode button 24 is mounted has a depth that is less than that of the anode button 24, the convex portion is not provided on this anode button-mounting portion, as shown in FIG. 4. FIG. 4 is a second preferred embodiment of the present invention. Referring to FIG. 4, the funnel 14' includes a body portion 14*a*' having an opened end connected to the panel 10, a neck portion 14*c*' for housing an electron gun 16, and a yoke portion 14*b*' connecting the body portion 14*a*' to the neck 14*c*'. The convex portion 28' is not provided on the anode button-mounting portion having the anode button 24.

The following Table 1 shows test results of a series of funnel samples made under a conventional art and the present invention.

| | Sample 1 | Sample 2 | Sample 3 |
|---|---|---|---|
| Increase of the funnel thickness (mm) | 0 | 2.0 | 1.0 |
| Stress in the vicinity of TOR (MPa) | 18 | 14 | 12 |
| Occurrence of implosion (%) | 90 | 90 | 30 |
| Amount of scattering fragments (kg) | 6 | 6.7 | 0.08 |
| Distance of fragment scattering (m) | 4 | 4 | 1.3 |

In Table 1, Sample 1 and Sample 2 are funnels made under the conventional art, and Sample 3 is a funnel made under the second preferred embodiment of the present invention.

Through the test, it was noted that as Sample 3 was reinforced by the convex portion formed on the outer surface of the body portion, when compared with the Sample 1 and the Sample 2, each of the stress in the vicinity of the TOR was reduced by 33% and 14%, and each of the occurrence of implosion was reduced by 67%.

In addition, it was further noted that when compared with the Sample 1 and Sample 2, each of the amount of the scattering fragments was reduced by 98% and 99%. Furthermore, as the thickness of the body portion of the present invention is designed to be varied, the crack propagation speed was reduced, thereby reducing each of the scattering distance by 68%.

Accordingly, it is proven that the thickness of the convex portion is preferably greater than 1.0 mm, and that the convex portion is preferably not formed on an anode button-mounting portion of the body portion and at a portion opposing the anode button-mounting portion.

Regardless of the shape of the yoke portion and the panel, it is preferable that the convex portion is formed on the body portion. In order to make a wide deflection angle funnel, the yoke portion can be a rectangular shape. However, the yoke portion can be either circular or non-circular in shape.

As described above, since the convex portion is partly formed on the body portion and the funnel, the stress and the occurrence of implosion at the yoke portion can be reduced while preventing the deflection property from being deteriorated.

In addition, since the convex portion is partly formed, it can be prevented that the weight of the funnel is excessively increased.

While this invention has been described in connection with what is presently considered to be the most practical and preferred embodiments, it is to be understood that the invention is not limited to the disclosed embodiments, but, on the contrary, is intended to cover various modifications and equivalent arrangements included within the spirit and scope of the appended claims.

What is claimed is:

1. A funnel for a cathode ray tube, comprising:

a first portion, comprising:

a body portion having an opened end connected to a panel;

a neck portion housing an electron gun; and a yoke portion including a first end connected to said body portion at a top-of-round (TOR) and a second end connected to said neck portion, a deflection yoke is mounted around said yoke portion; and a convex portion including a predetermined thickness is provided on an outer surface of said first portion of said funnel from a vicinity of the opened end to a vicinity of the top-of-round (TOR) in a direction of a tube axis.

2. The funnel of claim 1, wherein a convex portion is provided on an outer surface of said body portion and said yoke portion.

3. The funnel of claim 2, wherein a distribution area of said convex portion is defined to satisfy the following condition:

$$Y((+))z \leqq X \leqq TOR((+))10 \text{ millimeters}$$

where X is the distribution area of said convex portion in a direction of the tube axis, Y is a location of the opened end, z is 10 millimeters≦z≦50 millimeters, and the plus (((+))) indicates a direction from the opened end to said neck portion.

4. The funnel of claim 3, wherein the predetermined thickness of said convex portion is greater than 1.0 millimeter.

5. The funnel of claim 3, wherein said yoke portion has a section having a non-circular-shape.

6. The funnel of claim 3, wherein said body portion has an alignment mark formed on an outer surface of said body portion.

7. A funnel for a cathode ray tube, comprising:

a first portion, comprising:

a body portion having an opened end connected to a panel;

a neck portion housing an electron gun; and a yoke portion including a first end connected to said body portion at a top-of-round (TOR) and a second end connected to said neck portion, a deflection yoke is mounted around said yoke portion; and a convex portion including a predetermined thickness is provided on an outer surface of said first portion of said funnel from a vicinity of the opened end to a vicinity of the top-of-round (TOR) in a direction of a tube axis, wherein said convex portion is not provided on a portion of said body portion where an anode button is mounted.

8. The funnel of claim 7, wherein said convex portion is formed in a symmetrical shape when viewed from said neck portion.

9. A funnel for a cathode ray tube, comprising:

a body portion including an opened end connected to a panel;

a neck portion for housing an electron gun;

a yoke portion including a first end connected to said body portion at a top-of-round (TOR) and a second end connected to said neck portion, a deflection yoke is mounted around said yoke portion; and a convex portion including a thickness greater than 1 millimeter is provided at a predetermined distribution area, the distribution area being defined to satisfy the following condition:

$$Y((+))z \leqq X \leqq TOR((+))10 \text{ millimeters}$$

where X is the distribution area in a direction of the tube axis, Y is a location of the opened end, z is 10 millimeters≦z≦50 millimeters, and the plus (((+))) indicates a direction from the opened end to said neck portion.

10. A cathode ray tube having a funnel as defined in claim 9.

11. The funnel of claim 10, wherein said convex portion is provided on an outer surface of said body portion.

12. The funnel of claim 11, wherein a distribution area of said convex portion is defined to satisfy the following condition:

$$Y((+))z \leqq X \leqq TOR$$

where X is the distribution area of said convex portion in a direction of the tube axis, Y is a location of the opened end, z is 10 millimeters≦z≦50 millimeters, and the plus (((+))) indicates a direction from the opened end to said neck portion.

13. The funnel of claim 12, wherein a distribution area of said convex portion is defined to satisfy the following condition:

$$Y((+))10 \text{ millimeters} \leqq X \leqq TOR.$$

14. The funnel of claim 13, wherein said convex portion is provided on a portion of said body portion where an anode button is mounted.

15. The funnel of claim 13, wherein said yoke portion has a section having a non-circular-shape.

16. The funnel of claim 13, wherein said body portion includes an alignment mark formed on an outer surface.

17. A funnel for a cathode ray tube, comprising:

a body portion including an opened end connected to a panel;

a neck portion for housing an electron gun;

a yoke portion including a first end connected to said body portion at a top-of-round (TOR) and a second end connected to said neck portion a deflection yoke is mounted around said yoke portion; and a convex portion including a thickness greater than 1 millimeter is provided at a predetermined distribution area, the distribution area being defined to satisfy the following condition:

$$Y((+))10 \text{ millimeters} \leqq X \leqq TOR$$

where X is the distribution area in a direction of the tube axis, Y is a location of the opened end, and the plus (((+))) indicates a direction from the opened end to said neck portion, wherein said convex portion is provided on an outer surface of said body portion, wherein said convex portion is not provided on a portion of said body portion where an anode button is mounted.

18. The funnel of claim 17, wherein said convex portion is formed in a symmetrical shape when viewed from said neck portion.

19. A funnel for a cathode ray tube, comprising:

a body portion including an opened end connected to a panel;

a neck portion for housing an electron gun;

a yoke portion including a first end connected to said body portion at a top-of-round (TOR) and a second end connected to said neck portion, a deflection yoke is mounted around said yoke portion; and a convex portion including a thickness greater than 1 millimeter is provided at a predetermined distribution area, the distribution area being defined to satisfy the following condition:

$$Y((+))10 \text{ millimeters} \leqq X \leqq \text{TOR}$$

where X is the distribution area in a direction of a tube axis, Y is a location of the opened end, and the plus (((+))) indicates a direction from the opened end to said neck portion.

20. A cathode ray tube having a funnel as defined in claim 19.

* * * * *